US005108107A

United States Patent [19]

Shelton et al.

[11] Patent Number: 5,108,107

[45] Date of Patent: Apr. 28, 1992

[54] PRACTICE DEVICE FOR GOLFERS

[76] Inventors: William C. Shelton, Rte. #2 Box 584B, Cumberland, Md. 21502; Richard Ericsson Shelton, Jr., 401 Audubon St., Staunton, Va. 24401

[21] Appl. No.: 620,013

[22] Filed: Nov. 30, 1990

[51] Int. Cl.[5] ..... A63B 69/36

[52] U.S. Cl. ..... 273/200 R; 273/58 C

[58] Field of Search ..... 273/200 A, 200 B, 196, 273/197 R, 197 A, 198, 184 B, 185 C, 26 E, 26 EA, 58 C

[56] References Cited

U.S. PATENT DOCUMENTS 3,070,068 12/1962 Chapman ..... 273/200 R X
3,521,887 7/1970 Butkus ..... 273/200 R
4,660,835 4/1987 Lorurto ..... 273/200 R
4,927,154 5/1990 Boyer et al. ..... 273/200 R

FOREIGN PATENT DOCUMENTS 16297 of 1909 United Kingdom ..... 273/185 C

*Primary Examiner*—George J. Marlo

[57] ABSTRACT

A portable Golf Swing Practice Device designed to train the Golfer in how to develop a full swing. This device responds to a full swing by returning the tethered golf ball to the original general tee off area or beyond when struck with the golf club in the correct fashioned, a full swing. The tethering is accomplished by the use of ground attachment, a dacron line and a nylon stretch cord attached to a golf ball, assembled in such a fashion as to allow consistent repeated use. By seeing these results the Golfer can develop a full swing which in turn will develop a better Golfer.

1 Claim, 1 Drawing Sheet

PRACTICE DEVICE FOR GOLFERS

BACKGROUND OF THE INVENTION

It was desired to be able to practice the Golf Swing at home in the back yard using a standard golf ball.

To do this one must either purchase one of the current practice devices on the market or just hit Golf balls away, the later of which was chose not to be economical. After researching what was available a practice net was purchased which proved to be boring and the only thing accomplished was to hit a Gold ball, not knowing whether or not the ball was hit correctly. After reading many Golf magazines and studing a Golf Swing Training manule, writen by a prominent golfer, it was decided that a full swing of the golf club in a consistent fashion was desirable. It was felt that in order to achieve this one must be able to see ones swing results. The idea of attaching a string to the golf ball appeared to be a solution, however, the following problems had to be overcome before a practicle device was invented:

1. The ball attachment had to withstand repeated and consistently good and bad strikes of the golf club.
2. The line used in returning the golf ball had to be strong, and lightweight, it had to have good wearability and it must possess the ability to keep from being tied in knots from repeated extentions and contractions in the used process.
3. The elastic cord had to possess all of the above qualities plus would be able to
   1. stop line shock, which could disconnect the ball.
   2. Be large enough to return the ball in the desired manner which shows the result of a full swing.
4. Finally the ground attachment, which possed the greatest problem in as much as to
   1. Stay attached to the ground until the practice session was over.
   2. Have a low profile so that the line would not tangle on it.
   3. Have the ability to be put in it's anchoring position by mearly shoving it into the ground with no tools necessary.
   4. When removed the anchor attachment allows the entire assembly to be wound around it for storage when not in use.

The length of the cord, the length of the elastic section, the diameter of both the cord and the elastic section the size and shape of the anchor were all determined after many months of expermentation. The inventors would also like to note at this time that the anchor developed during this expermentation is of perticular interest in as much as it's ability to anchor things to the ground and could have many other important uses which will be brought to attention in the detailed description of the invention.

SUMMARY OF THE INVENTION

When using a standard golf ball, attached to a cord, which is attached to a elastic section of cord, (to absorb the impact load and return the ball), and is anchored to the ground with a unique device, a Full Swing, (when used to hit the golf ball with the golf club), is detectable. The advantage of the Power Driver is that it is small and convenient for use at any time practice is desired.

BRIEF DESCRIPTION OF THE DRAWING

Drawing Shows Power Driver Complete

1. Land Anchor
2. Nylon Braded Stretch Cord
3. Dacron Line
4. Attachment Loop
5. Screw Eyes
6. Silicone Adhesive
7. Standard Golf Ball Land Anchor is shown inserted in the ground in the drawing. Ground is indicated by dark lines.

DETAILED DESCRIPTION OF THE INVENTION

1. LAND ANCHOR

Figure 1:
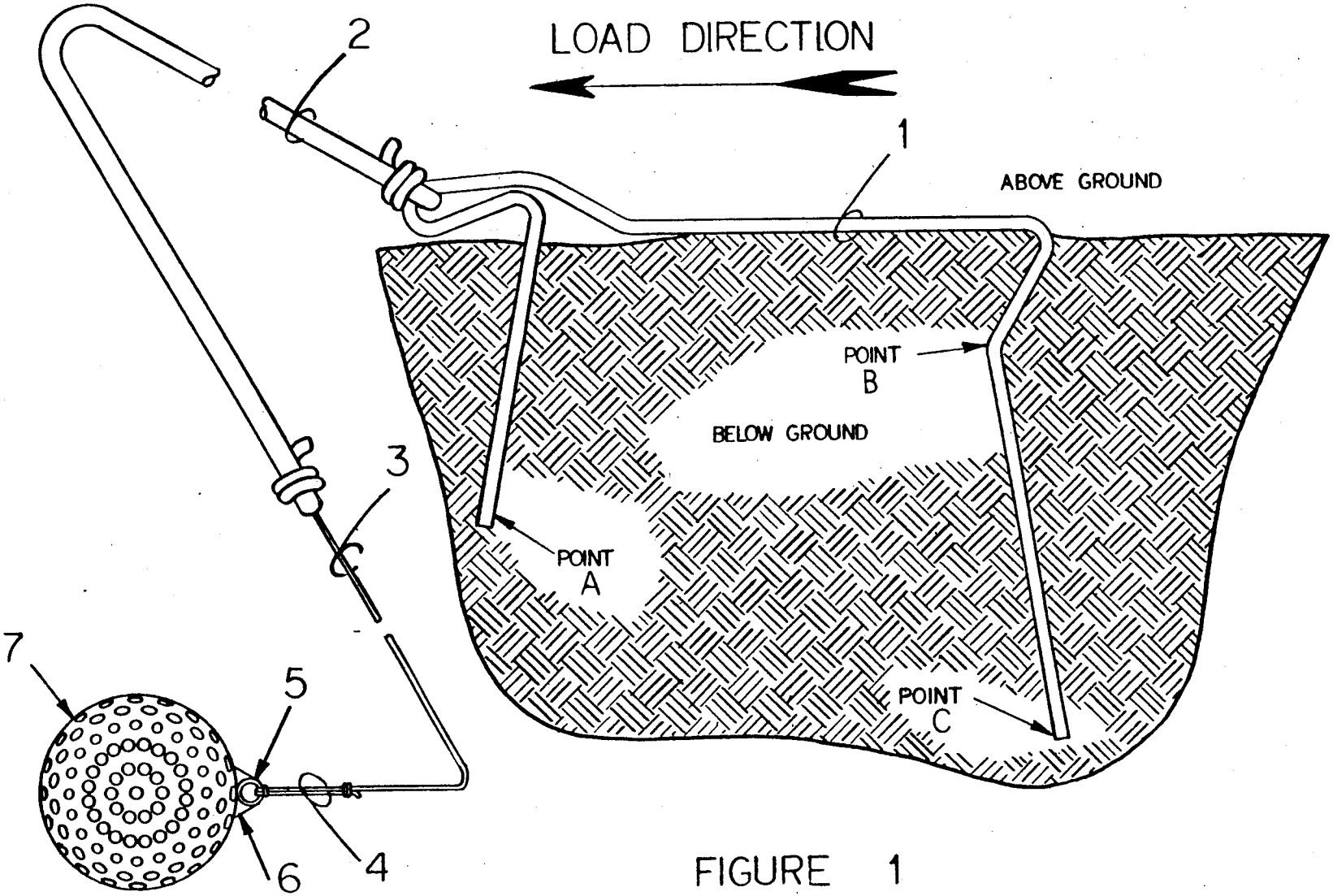

Constructed out of 5/32 carbon steel wire and bent in such a fashion as to pull itself tight to the ground when a load is placed in the load direction indicated on the drawing. This tightening effect is achieved by means of an action at the front loop of the anchor:

When force is applied in the load direction to the front loop, two things happen at the same time.

1. The front leg of the anchor is pulled forward transmitting it's energy along the S curve in the wire to the end, deepest in the ground at point A.
2. Forward force pulls the top section of the wire that lays along the ground forward thus transmitting it's energy to the rear leg of the anchor thru the S curve in the wire to point B at which point all forward energy is reversed to point C by means of a leaver action against the earth it's in, thus giving it a tightening effect.

Although the Land Anchor was developed for use as part of the Powder Driver, the Inventors would like to point out that the Land Anchor would be ideal for use as tent pegs, badmitten net anchors, Volley ball net anchors and any other use around the yard mainly due to there safety factors as there would be no sharp objects sticking up that could be fallen on. This anchor could have other uses even yet not mentioned. If one would increase the size from wire to heavy steel and longer legs the same effect would be achieved. Possibly telephone Pole guide wire anchors, Boat anchors when next to the shore; etc.

2. NYLON BRADED STRETCH CORD

This cord is made of a rubber core covered with a quality nylon fiber. This cord was found in the upholstery business and it's function there was for use in seat covers.

This cord is of 3/16 diameter and is give (5) feet long, being attached at the Land Anchor by means of a knot or eyelet and attached at #3 Nylon braded cord by means of a knot or eyelet.

The size and length of this stretch cord are what gives the Powder Drive it's ability to snap the golf ball back to the general area of were the ball was struck or beyond. Beyond, indicating a Full Swing of the golf club.

3. DACRON LINE

This line is of 1/32 in diameter and fourty five (45) feet in length, it is attached to #2 stretch cord by means of a knot or eyelet and to the eyelet #5 embedded in the golf ball #7 by means of a loop #4 which allows the exchange of the golf ball.

This line was found in the fishing industry for deep sea fishing. It is one hundred and eighty (180) pound test fishing line.

4. ATTACHMENT LOOP

This loop is tied on the end of #3 the Dacron line, so that one can replace the golf ball.

This is achieved by sticking #4 Attachment loop thru #5 eyelet, taking loop over golf ball and allowing it to tighten up on #5 eyelet.

5. SCREW EYE

This eye is screwed into the golf ball ½ inch.

The eyelet size is 13/16 with wood screw threads.

6. SILICONE ADHESIVE

This is used to keep #4 Dacron line attachment loop from going down to bottom of eyelet were eyelet is squeezed shut which would cause a ware point and would also let the line tighten up under the eyelet thus hurting the change ability of golf balls.

7. STANDARD GOLF BALL

The total length of the Power Driver is fifty (50) feet plus the Anchor. Upon completion of a practice session one would remove the anchor from the ground simply by pulling on the center of the anchor and would proceed to wind the stretch cord and Dacron line up on the legs of the anchor, making the entire assembly small enough to put into ones back pocket.

Finally the drawing shows the Powder Driver at actual size, except that the line and cord are shown broken length, to get it all on the drawing, but are actual diameter.

We claim:

1. A portable, directional, golf swing practice device, consisting of a ground attachment, formed out of one continuous length of wire, that has two vertical uprights, with one horizontal section connecting them, and an attachment loop at the junction of one of said vertical uprights and one end of said horizontal section to form a front end, which has attached to it an elastic section of cord of specific length, which is attached to a non-elastic section of cord of specific length, which is attached to a screw eyelet, which is screwed into a standard one piece golf ball, which would be teed up by the golfer for a practice session, during which the golfer strikes the golf ball with enough force by the golf club, that would outstretch the said non-elastic and elastic cords to their full lengths, at which point the forward force would then engage the elastic length of cord and stretch it to whatever the forward momentum would extend it, then return the ball to a place behind the golfer, thereby giving the golfer a gauge to measure the clubhead speed or full swing one has generated.

* * * * *